US006460868B2

(12) United States Patent
Madrid

(10) Patent No.: US 6,460,868 B2
(45) **Date of Patent: *Oct. 8, 2002**

(54) CORRUGATED SKATEBOARD DECK AND METHOD OF CORRUGATING SKATEBOARD DECKS

(76) Inventor: Jeffrey Madrid, 1500 Kashlan Rd., La Habra Heights, CA (US) 90631

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/420,601

(22) Filed: Oct. 19, 1999

(65) Prior Publication Data

US 2001/0040356 A1 Nov. 15, 2001

(51) Int. Cl.[7] ..... B62M 1/00
(52) U.S. Cl. ..... 280/87.042; 144/349
(58) Field of Search ..... 280/14.21, 609, 280/610, 87.041, 87.042; 441/68, 74; D21/760, 765, 769; 144/256.3, 349, 352, 358

(56) References Cited

U.S. PATENT DOCUMENTS

| | | | | | |
|---|---|---|---|---|---|
| 1,154,806 | A | * | 9/1915 | Redmon | 144/349 |
| 2,486,689 | A | * | 11/1949 | Tibores et al. | 280/87.041 |
| 2,499,959 | A | * | 3/1950 | Kruse et al. | 144/256.3 |
| 2,531,946 | A | * | 11/1950 | Parker | 441/74 |
| 2,926,364 | A | * | 3/1960 | Cox | 280/610 |
| 3,118,157 | A | * | 1/1964 | Houser | 280/610 |
| D222,158 | S | * | 10/1971 | Noches | D21/765 |
| 3,620,547 | A | * | 11/1971 | Vaverek | 280/87.042 |
| 3,878,015 | A | * | 4/1975 | Johnston | 144/352 |
| 4,150,838 | A | * | 4/1979 | Lappage | 280/87.042 |
| 4,233,752 | A | * | 11/1980 | Kleinguenther | 34/331 |
| 4,234,204 | A | * | 11/1980 | Tibbals | 280/87.042 |
| 4,255,221 | A | * | 3/1981 | Young | 144/349 |
| D261,544 | S | * | 10/1981 | Cramer | D21/765 |
| 4,533,150 | A | * | 8/1985 | Hardy | 280/609 |
| 4,816,103 | A | * | 3/1989 | Ernest | 144/256.3 |
| 5,029,661 | A | * | 7/1991 | Wallace et al. | 280/87.042 |
| 5,073,431 | A | * | 12/1991 | Martinuzzo | 144/352 |
| 5,106,331 | A | * | 4/1992 | Lizarazu | 441/74 |
| 5,141,243 | A | * | 8/1992 | Meatto | 280/609 |
| 5,344,177 | A | * | 9/1994 | Rouser et al. | 280/610 |
| 5,944,938 | A | * | 8/1999 | Winterowd et al. | 144/352 |
| 6,059,307 | A | * | 5/2000 | Western | 280/87.042 |
| 6,182,986 | B1 | * | 2/2001 | Smith | 280/87.042 |
| 6,214,142 | B1 | * | 4/2001 | Saputo | 280/87.042 |
| 6,315,860 | B1 | * | 11/2001 | Holmberg et al. | 144/352 |

FOREIGN PATENT DOCUMENTS

| | | | | |
|---|---|---|---|---|
| CH | 153866 | * | 7/1932 | 280/609 |
| NO | 85837 | * | 5/1955 | 280/609 |
| SU | 1768195 | * | 10/1992 | 280/87.042 |

* cited by examiner

*Primary Examiner*—Frank Vanaman
(74) *Attorney, Agent, or Firm*—Edgar W. Averill, Jr.

(57) ABSTRACT

A corrugated skateboard deck and method of corrugating skateboard decks in the skateboard deck manufacturing process. The corrugated skateboard deck has elongated corrugations embossed into at least one of its top and bottom surfaces and generally extending between first and second ends of the skateboard deck. The elongated corrugations are made up of ridges and grooves which are pressure-formed in a method of corrugating the surfaces of skateboard decks. This method utilizes a high-density corrugated template to emboss corrugations under high pressures.

4 Claims, 3 Drawing Sheets

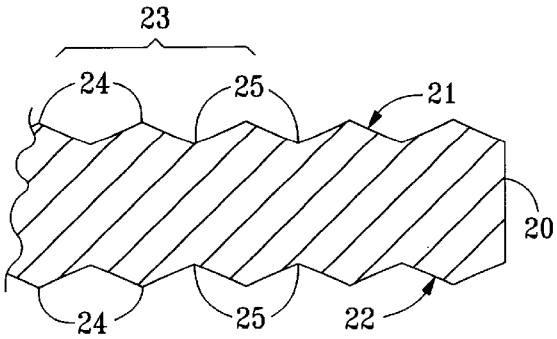
FIG. 6A
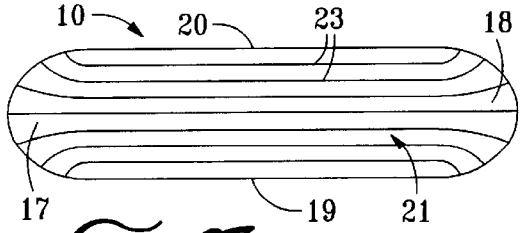
FIG. 7A
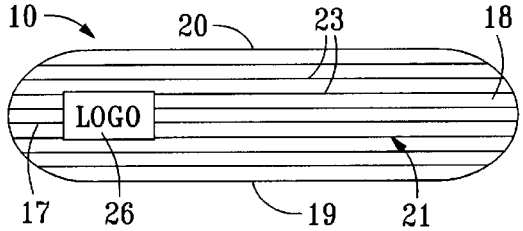
FIG. 7B
FIG. 6B
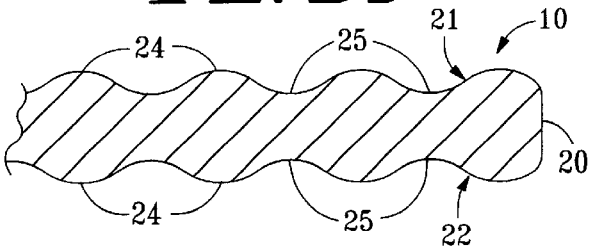
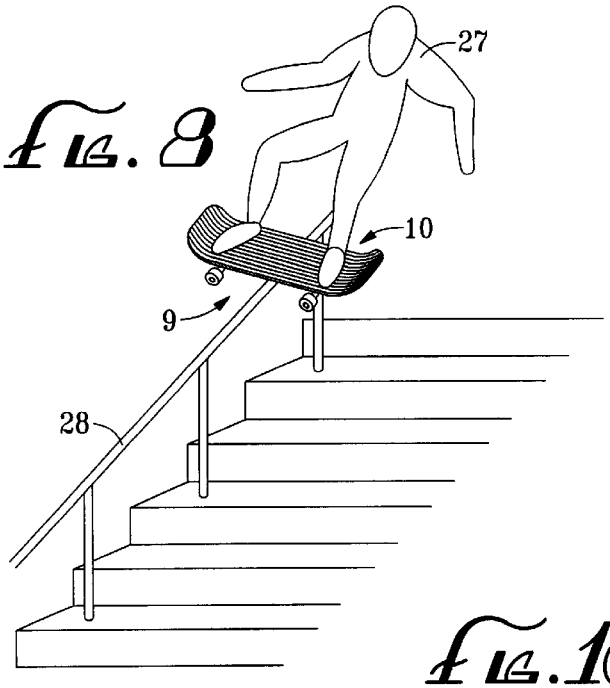
FIG. 8
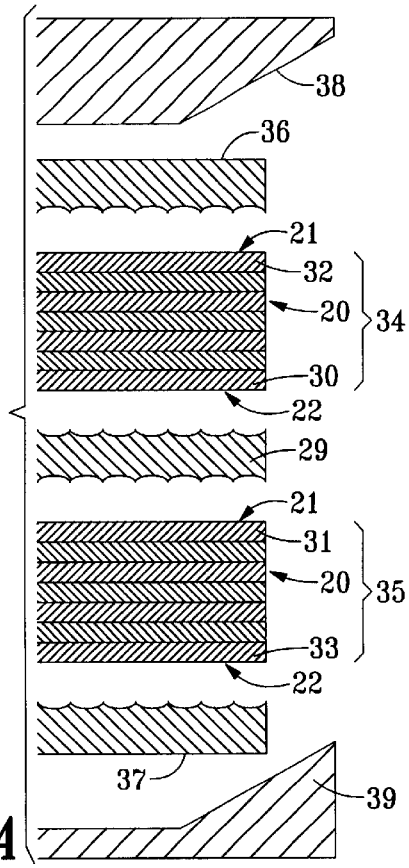
FIG. 10A FIG. 9A
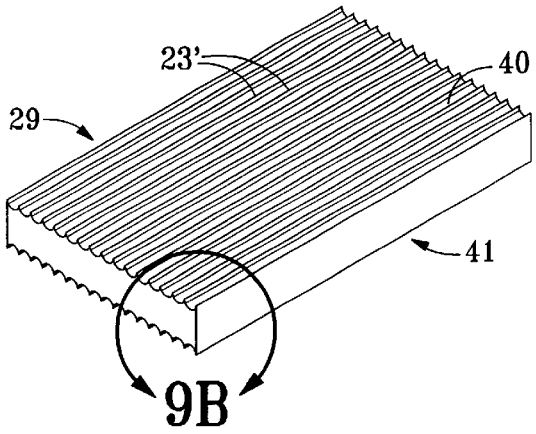
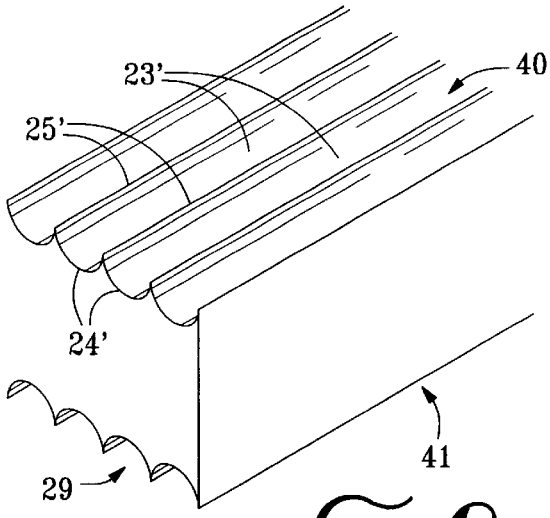
FIG. 9B
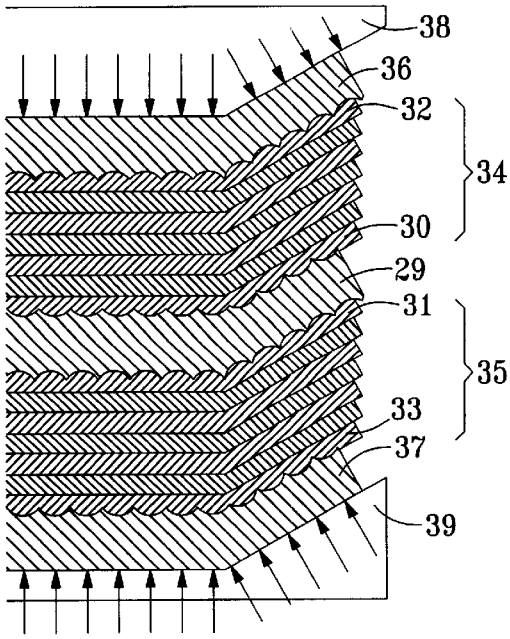
FIG. 10B

CORRUGATED SKATEBOARD DECK AND METHOD OF CORRUGATING SKATEBOARD DECKS

BACKGROUND OF THE INVENTION

The field of the invention generally pertains to skateboard decks and methods of manufacturing skateboard decks. The invention relates more particularly to a corrugated skateboard deck and a method of corrugating the surfaces of skateboard decks in a skateboard deck manufacturing process.

The popularity of skateboarding has grown continuously in recent years, as well as the demand for high-performance skateboards. In part, this has been due to the evolution of skateboarding into an extreme sport involving amazing and dare-devilish techniques and maneuvers. One popular skateboarding maneuver in particular involves sliding on rails and ledges using the bottom surface of a skateboard deck as the sliding surface. However, this and other high-impact skateboarding maneuvers can create extreme levels of stress in skateboard decks. A high degree of torsional rigidity, durability, and performance features is therefore required in skateboard decks to withstand the extreme conditions associated with today's modern skateboarding styles without sacrificing skateboarding performance.

Various skateboard deck designs and manufacturing methods have been developed to improve the strength, durability, and/or performance of skateboard decks. Some particular developments in skateboard deck design have been angled "nose" and "tail" ends of skateboard decks, and "concave decks" having upwardly curving side edges. These features are typically pressure-formed in a mold, with a bonding agent functioning to join and set multiple plies of wood in the shape of the mold. However, while these features enable skateboarders to better control their skateboards when performing skateboard tricks and maneuvers, it has little effect on the strength and durability of the skateboard deck.

Additionally, various types of wood plies and bonding agents have been used to improve the strength and durability of skateboard decks. However, measures to strengthen, enhance, and reinforce skateboard decks have typically come at a high cost to skateboard deck weight, which can hurt skateboarding performance.

BRIEF SUMMARY OF THE INVENTION

It is an object of the present invention to provide an improved skateboard deck having a plurality of elongated corrugations which increase torsional rigidity and enable improved performance of various skateboard techniques and maneuvers.

It is a still further object of the present invention to provide a simple, efficient, and economic method of corrugating the surfaces of skateboard decks in a skateboard deck manufacturing process, thereby increasing torsional rigidity of the skateboard deck and enabling improved performance of various skateboard maneuvers and techniques.

The present invention is for an improved skateboard deck having a generally planar configuration with a first end, a second end opposite the first end, a first elongated side edge between the first and second ends, a second elongated side edge between the first and second ends and opposite the first elongated side edge, a top surface, and a bottom surface. At least one of the top and bottom surfaces has a plurality of elongated corrugations between the first and second ends.

And the plurality of elongated corrugations comprises a plurality of ridges and grooves which extend generally longitudinally between said first and second ends, and each ridge of said plurality of ridges having a single contact point at its apex when viewed in cross-section.

Additionally the present invention is for a method of corrugating skateboard decks in a skateboard deck manufacturing process. In a first preferred embodiment, the method comprises the initial step of placing a high-density corrugated template between a top ply of a first set of wood plies and a bottom ply of the second set of wood plies. Each of the first and second sets of wood plies is prepared with a bonding agent in-between the wood plies. Next, a pressure is applied on the first and second sets of wood plies while the bonding agent sets. This is followed by the steps of releasing the pressure, and removing the high-density corrugated template. Similarly, in a second preferred embodiment, a high-density corrugated template is placed on an outer ply of a set of wood plies which is prepared with a bonding agent in-between the wood plies. A pressure is then applied on the high-density corrugated template and the set of wood plies while the bonding agent sets. Finally, the pressure is released and the high-density corrugated template is removed.

BRIEF DESCRIPTION OF THE DRAWINGS

FIG. 6A illustrates a second preferred embodiment of the plurality of ridges and grooves as seen from a cross-sectional view of the corrugated skateboard deck similar to the cross-sectional view shown in FIG. 5.

FIG. 6B illustrates a third preferred embodiment of the plurality of ridges and grooves as seen from a cross-sectional view of the corrugated skateboard deck similar to the cross-sectional view shown in FIG. 5.

FIG. 7A illustrates a second preferred embodiment of the plurality of elongated corrugations as seen from a top view of the corrugated skateboard deck, similar to the top view shown in FIG. 2.

FIG. 7B illustrates a third preferred embodiment of the plurality of elongated corrugations as seen from a top view of the corrugated skateboard deck, similar to the top view shown in FIG. 2.

FIG. 8 illustrates a popular skateboarding maneuver utilizing the bottom surface of the corrugated skateboard deck for sliding.

FIG. 9A is a perspective view of a first preferred embodiment of the high-density corrugated template having two corrugated faces and in its unbiased state.

FIG. 9B is an enlarged perspective view taken along the circle 9B in FIG. 9A of a first preferred embodiment of the high-density corrugated template having two corrugated faces and in its unbiased state.

FIG. 10A is a cross-sectional, exploded view of a layered combination of the high-density corrugated templates and the two sets of wood plies prior to applying a pressure in a pressure-mold in the method of corrugating skateboard decks in a skateboard deck manufacturing process.

FIG. 10B is a cross-sectional view of the high-density corrugated templates and the two sets of wood plies as a pressure is applied in a pressure-mold in the method of corrugating skateboard decks in a skateboard deck manufacturing process.

DETAILED DESCRIPTION OF THE PREFERRED EMBODIMENTS

Figure 1:
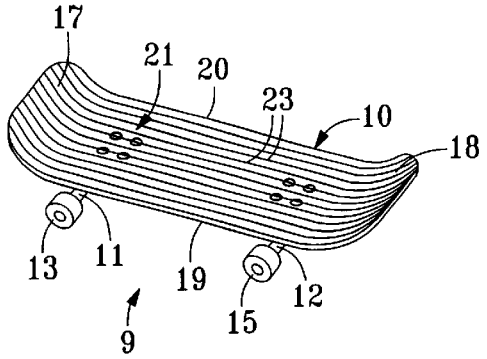
FIG. 1 is a perspective view of a complete skateboard as generally seen from the top, assembled with the corrugated skateboard deck.
Figure 2:
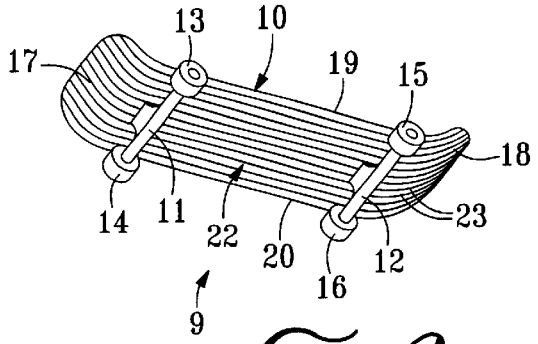
FIG. 2 is a perspective view of a complete skateboard as generally seen from the bottom, assembled with the corrugated skateboard deck.

Referring now to the drawings, FIGS. 1 and 2 show perspective views of a complete skateboard, generally indicated by reference character 9, as generally seen from the top and bottom, respectively. As can be seen in FIGS. 1 and 2, the complete skateboard 9 is assembled from several skateboard components, including the corrugated skateboard deck, generally indicated by reference character 10, and other skateboard components, including a pair of trucks 11, 12, four wheels 13–16, and four wheel bearings (not illustrated).

As can be seen from FIGS. 1–3B, the corrugated skateboard deck 10 has a generally planar configuration including a first end 17, a second end 18 opposite the first end 17, a first elongated side edge 19 between the first and second ends 17, 18, a second elongated side edge 20 between the first and second ends 17, 18 and opposite the first elongated side edge 19, a top surface 21, and a bottom surface 22.

Additionally, at least one of the top 21 and bottom 22 surfaces of the corrugated skateboard deck 10, has a plurality of elongated corrugations 23 between the first and second ends 17, 18 (see FIG. 2). The plurality of elongated corrugations 23 functions to increase the longitudinal stiffness and torsional rigidity of the skateboard deck 10, thereby decreasing the effects of stress experienced by the skateboard deck 10.

Figure 3A:
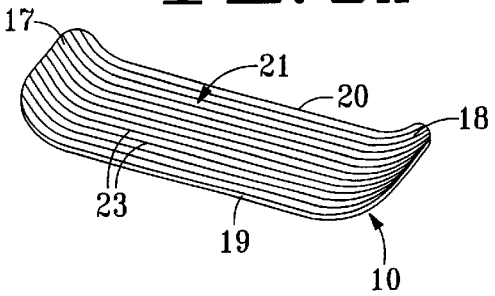
FIG. 3A is a perspective view of the corrugated skateboard deck, depicting a first preferred embodiment of the plurality of elongated corrugations.
Figure 3B:
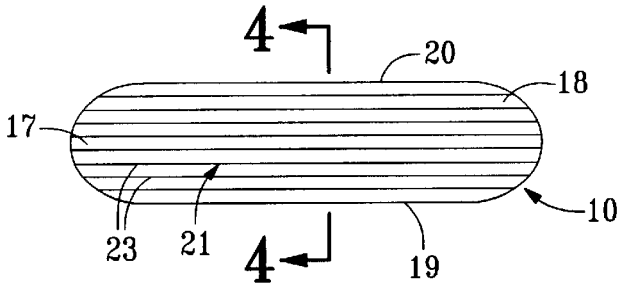
FIG. 3B is a top view of the corrugated skateboard deck in FIG. 3A, depicting a first preferred embodiment of the plurality of elongated corrugations.

As can be best seen in FIGS. 3A–B, showing the skateboard deck 10 alone, a first preferred embodiment of the plurality of elongated corrugations 23 generally extends longitudinally between the first and second ends 17, 18 in a parallel pattern. Alternatively, FIGS. 7A and 7B show second and third embodiments, respectively, of the plurality of elongated corrugations 23 as seen from a top view of the skateboard deck 10. As can be seen in FIGS. 7A–B, the skateboard deck 10 can have curvilinear corrugation patterns (FIG. 7A) or a logo or other graphic image design (FIG. 7B), but is not limited only to such. The pattern of the elongated corrugations 23 can be widely varied, and the placement can be concentrated along high-impact stress points, such as the points of truck attachment.

Figure 4:
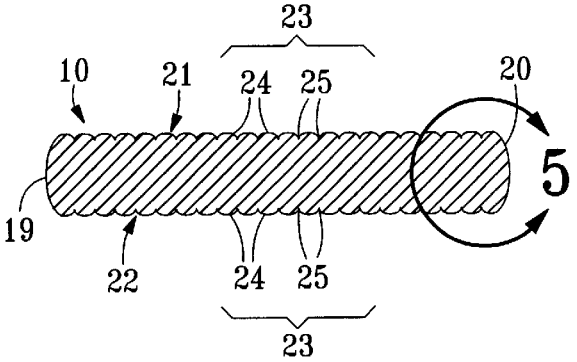
FIG. 4 is a cross-sectional view of the corrugated skateboard deck taken along the line of 4—4 of FIG. 3B, depicting a first preferred embodiment of the plurality of ridges and grooves.
Figure 5:
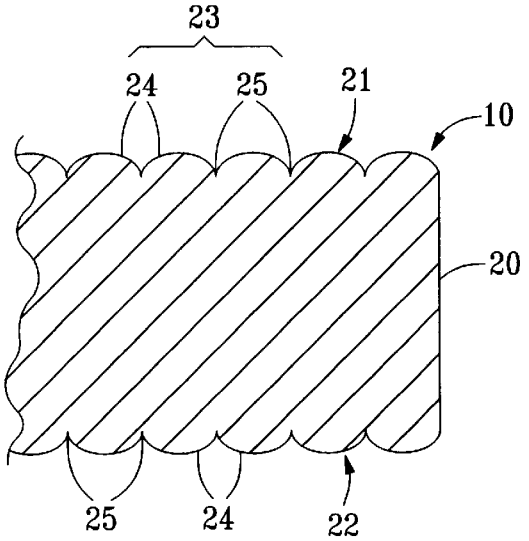
FIG. 5 is an enlarged cross-sectional view of the corrugated skateboard deck taken along the circle 5 of FIG. 4.

The plurality of corrugations 23 shown in FIGS. 1–3B, and 7A–B are further comprised of a plurality of ridges 24 and grooves 25, as shown in FIGS. 4–6B. A first preferred embodiment of the plurality of ridges 24 and grooves 25 is shown in FIGS. 4–5. As can be best seen in FIG. 5, showing a detailed, enlarged view of the skateboard deck 10 in FIG. 4, each ridge 24 of the first preferred embodiment preferably has a convex cross-section and a curvilinear apex, but is not limited only to such. As can be seen in FIGS. 6A–B showing second and third embodiments of the plurality of ridges 24 and grooves 25, the ridges 24 can also have generally pointed apexes and generally conical cross-section (FIG. 6A), as well as a continuous wave-like cross-section (FIG. 6B).

One advantage of having elongated corrugations 23 along the bottom surface 22 of a skateboard deck 10 is that it provides less contact area when performing sliding maneuvers along the bottom surface 22 of the skateboard deck 10. Contact area is reduced because of the separation and distance between the apexes of each ridge 24 by an intermediate groove 25 (See FIG. 5). FIG. 8 illustrates a popular skateboarding maneuver known as a "rail slide," where a skateboarder 27 uses the skateboard 9, to leap onto and slide along a handrail 28. The plurality of elongated corrugations 23 on the bottom surface 22 enable smoother and faster slides when performing this maneuver. Additionally, because the plurality of corrugations 23 strengthen torsional rigidity of the skateboard deck 10, it is able to better withstand the stress and impact commonly associated with such rail slides.

Preferably, corrugated skateboard decks 10 are manufactured using a method of corrugating skateboard decks as shown in FIGS. 10A–B. FIGS. 10A–B show a preferred embodiment of the method utilizing high-density corrugating templates 29, 36, 37 and first and second sets of wood plies, generally indicated by reference characters 34 and 35, respectively. The high-density corrugating templates 29, 36, 37 are preferably formed from high-density polyethylene or other high-density plastic, with the corrugation design milled on two-sides (29) or only one-side (36, 37). FIGS. 9A–B show a first preferred embodiment of the high-density corrugated template 29 having two corrugated faces, an upper corrugated face 40, and a lower corrugated face 41. As can be best seen in FIG. 9B, both the upper and lower corrugated faces 40, 41 have ridges with pointed apexes 25' and curvilinear grooves 24' which emboss the grooves 25 and curvilinear ridges 24, respectively (see FIG. 5). Various corrugation designs can be easily milled into corrugation templates with the use of CAD/CAM systems.

As can be best seen in FIGS. 10A–B, the two sets of wood plies 34, 35 each have multiple layers or plies of wood, (commonly seven layers) which are prepared with a bonding agent in-between the wood plies. Although only two sets of wood plies 34, 35 are illustrated in FIGS. 10A–B, additional sets of wood plies may be further stacked on top of first and second sets of wood plies 34, 35 to produce a greater number of skateboard decks 10 per pressing. As can be seen in FIG. 10A, the two-sided high-density corrugated template 29 is placed in-between a bottom ply 30 of the first set of wood plies 34 and a top ply 31 of the second set of wood plies 35. The two one-sided high-density corrugated templates 36, 37 are placed at remaining outer plies 32 and 33, respectively. This layered combination is placed in a mold having an upper mold 38 and a lower mold 39.

Subsequently, as can be best seen in FIG. 10B, a pressure P is then applied to the two sets of wood plies 32, 33 to shape the two sets of wood plies 34, 35 to that of the mold 38, 39. As can be seen in FIGS. 9A and 10A, the high-density corrugating templates 29 (also FIG. 9B), 36, 37 have a generally straight and flat-shaped cross-section prior to applying the pressure P. However, as can be seen in FIG. 10B, the high-density corrugated templates 29, 36, 37 are sufficiently flexible to bias and conform to the contour of the mold 38, 39.

The pressure P is applied until the bonding agent sets and can retain the shape of the mold 38, 39. It is during this pressure-molding process that the high-density corrugated templates 29, 36, 37 emboss the plurality of elongated corrugations 23 onto the bottom surface 30 of the first set of wood plies 34, the top surface 31 of the second set of wood plies 35, and the outer plies 32, 33 of the first and second sets of wood plies 34, 35, respectively. After the bonding agent has set, the applied pressure P is released, and the high-density corrugated templates 29, 36, 37 are removed. The properties of the high-density corrugated templates 29, 36, 37 will typically return to its original unbiased shape as shown in FIG. 9A for repeated use in subsequent pressings.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A method of corrugating skateboard decks in a skateboard deck manufacturing process, said method comprising the steps of:

placing a high-density corrugated template between a top ply of a first set of flat wood plies, and a bottom ply of a second set of flat wood plies, each of said first and second sets of flat wood plies prepared with a bonding agent in-between said wood plies, said high-density corrugated template having a body portion in a first shape;

placing said corrugated templates, said first set of flat wood plies and said second set of flat wood plies between an upper mold and a lower mold, said upper mold and said lower mold having a shaped, non-planar configuration on a force-applying surface thereof;

applying a force on said upper mold and said lower mold to transfer said force to said first and second sets of flat wood plies, said shaped non-planar force-applying surfaces causing said flat wood plies to bend and said corrugated templates to bend into a second shape, said applying a force step being carried out without confining said upper mold, said lower mold and said sets of flat wood plies in a hermetically sealed chamber;

retaining said force a sufficient time to permit said bonding agent to set and to create first and second sets of shaped wood plies;

releasing said force; and removing said high-density corrugated templates and said first and second sets of shaped wood plies.

2. A method of corrugating skateboard decks in a skateboard deck manufacturing process as in claim 1, wherein said high-density corrugated template is formed from high-density polyethylene.

3. A method of corrugating skateboard decks in a skateboard deck manufacturing process, said method comprising the steps of:

placing a high-density corrugated template on an outer ply of a set of flat wood plies, said set of flat wood plies prepared with a bonding agent in-between said flat wood plies, said high-density corrugated template having a flat body portion in a first shape;

placing said corrugated template and, said set of flat wood plies between an upper mold and a lower mold, said upper mold and said lower mold each having a shaped non-planar configuration on a force-applying surface thereof;

applying a force on said upper mold and said lower mold to transfer said force to said set of flat wood plies while said bonding agent sets, said shaped non-planar force-applying surfaces causing said flat wood plies to bend to form shaped wood plies and said corrugated templates to bend to a second shape, said applying a force step being carried out without confining said upper mold, said lower mold and said set of flat wood plies in a hermetically sealed chamber;

releasing said force; and removing said high-density corrugated template and said shaped wood plies.

4. A method of corrugating skateboard decks in a skateboard deck manufacturing process as in claim 3, wherein said high-density corrugated template is formed from high-density polyethylene.

* * * * *